US006322666B1

(12) United States Patent
Luontama et al.

(10) Patent No.: US 6,322,666 B1
(45) Date of Patent: Nov. 27, 2001

(54) REGULATION SYSTEM AND METHOD IN A PAPER MACHINE

(75) Inventors: Matti Luontama; Harri Mustonen; Pekka Pakarinen, all of Jyväskylä (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/253,102

(22) Filed: Feb. 19, 1999

(30) Foreign Application Priority Data

Feb. 23, 1998 (FI) ..... 980403

(51) Int. Cl.[7] ..... D21F 1/06

(52) U.S. Cl. ..... 162/198; 162/216; 162/263; 162/252; 162/259; 162/DIG. 11; 700/128

(58) Field of Search ..... 162/198, DIG. 10, 162/DIG. 11, 216, 202, 212–215, 263, 252–254, 256, 258, 336, 343, DIG. 259; 700/127–129; 73/159, 852, 849; 356/429, 432; 250/559, 571

(56) References Cited

U.S. PATENT DOCUMENTS

| | | | | |
|---|---|---|---|---|
| 3,547,775 | * | 12/1970 | Bossen et al. | 162/198 |
| 3,620,914 | * | 11/1971 | Rocheleau | 162/198 |
| 4,133,713 | | 1/1979 | Chuang | 162/216 |
| 4,151,415 | | 4/1979 | Lipke | 250/333 |
| 4,648,712 | * | 3/1987 | Brenholdt | 356/73 |
| 4,687,548 | * | 8/1987 | Ilmoniemi et al. | 162/216 |
| 4,936,141 | * | 6/1990 | Anderson, Jr. et al. | 73/159 |
| 4,947,684 | * | 8/1990 | Balakrishnan | 6/431 |
| 4,955,720 | * | 9/1990 | Blecha et al. | 356/429 |
| 5,101,661 | * | 4/1992 | Cresson et al. | 73/159 |
| 5,145,560 | * | 9/1992 | Grenlulnd | 162/198 |
| 5,361,638 | * | 11/1994 | Pettersson et al. | 73/800 |
| 5,393,378 | * | 2/1995 | Yakabe et al. | 162/61 |
| 5,753,081 | * | 5/1998 | Graf | 162/198 |
| 5,825,653 | * | 10/1998 | Huovila et al. | 364/471.02 |
| 5,827,399 | * | 10/1998 | Niettaanmaki et al. | 162/198 |
| 5,843,281 | | 12/1998 | Huovila | 162/216 |
| 5,853,545 | * | 12/1998 | Haraldsson et al. | 162/343 |

FOREIGN PATENT DOCUMENTS

| | | | |
|---|---|---|---|
| 81848 | 8/1990 | (FI) | D21F/1/00 |
| 934793 | 10/1993 | (FI) | D21F/1/02 |
| 9701088 | 1/1997 | (WO) | G01N/22/00 |

OTHER PUBLICATIONS

English Abstract of FI 980319 (1 page).

* cited by examiner

*Primary Examiner*—Jose Fortuna
(74) *Attorney, Agent, or Firm*—Steinberg & Raskin, P.C.

(57) ABSTRACT

A feedback-connected on-line regulation system for a headbox of a paper or board machine. The headbox includes a flow duct for stock suspension or separate flow ducts placed one above the other, each flow duct extending from an inlet header of the headbox into its slice channel. A stock suspension jet is discharged from the slice opening of the slice channel onto the forming wire or into the forming gap formed between forming wires. The regulation system includes a regulator unit and a set value unit. Measurement values are passed from the headbox system to the regulator unit and from the regulator unit, control values are obtained for controlling the actuators of the headbox system. The regulation system also includes an on-line If arrangement for measurement of the dried paper web or the paper web to be dried, and includes measurement of the distribution of fibers in the plane of the paper web. By means of the measurement signal obtained from this measurement arrangement, the actuators of the headbox are controlled by feedback so as to achieve a distribution of fiber orientation and a corresponding MD/CD ratio of strength in accordance with the set value in the paper web to be produced under control of the regulation system.

20 Claims, 4 Drawing Sheets

REGULATION SYSTEM AND METHOD IN A PAPER MACHINE

FIELD OF THE INVENTION

The present invention relates to a feedback-connected on-line regulation system for a headbox of a paper or board machine, which headbox comprises a flow duct for stock suspension or separate flow ducts placed one above the other. Each flow duct extends from an inlet header of the headbox into the slice channel of the headbox. The stock suspension jet is discharged from a slice opening of the slice channel onto a forming wire or into a forming gap formed between forming wires. The regulation system comprises a regulator unit and a set value unit. Measurement values are passed to the regulator unit from the headbox system. From the regulator unit, control values are obtained by whose means the actuators of the headbox system are controlled.

The present invention also relates to a method for regulating a headbox in a paper or board machine.

BACKGROUND OF THE INVENTION

In the prior art, in paper or board machines, a stock suspension jet is discharged out of a slice opening onto a forming wire or into a forming gap between forming wires. The cross-direction profile of the slice opening determines the profile of the stock jet. The profile of the slice opening is regulated such that it is also possible to compensate for faults in the stock jet that arise in or before the headbox.

A headbox, in particular a multi-layer headbox, is a difficult item to regulate because the stock jet formation process involves a number of different parameters, which have various cross effects, which effects may further depend on the raw-materials that are used, on the grade of paper that is being produced, and/or on the geometry of the headbox and on the mode of running of the paper machine. However, in the manufacture of a paper product of good quality, in particular of printing and writing paper, in particular when the multi-layer technique is applied, the ratios of speed and flow quantities between the different stock flows and the settings of these parameters in relation to the wire speed must be sufficiently precisely controllable.

From the prior art, a system for the control of the basis weight profile of the headbox in a paper machine is known. This system comprises an angular-gear/stepping motor actuator, by whose means the top slice bar which regulates the slice profile is controlled by adjusting spindles attached to the slice bar at a spacing of about 10 cm to about 15 cm. The spindles are displaced by the actuator placed at one of their ends. The profiling of the top slice bar of the headbox usually takes place so that each regulation gear is controlled separately in a sequence of treatment taking place one after the other. In order that the positioning could be carried out with the required precision of about 10 $\mu$m, an electronic system for measurement of the locations of the regulation spindles is also needed.

Errors in the fiber orientation in a paper web arise mainly from the following causes. A smaller amount of stock flows at the edges of the stock flow channel in the headbox. This edge effect causes a very strong linear distortion in the profile. Errors of profile in the turbulence generator in the headbox usually cause a non-linear distortion inside the lateral areas of the flow channels. The acceleration produced in the slice cone of the headbox equalizes the profile errors in the main flow, but it is exactly that effect that produces the cross-direction flow. Errors of orientation in the paper web are indirectly also caused by the operation of the dryer section because, during drying, the paper web can shrink unevenly in the cross direction so that the lateral areas shrink to a considerably greater extent than the middle area. Attempts are made to compensate for the unevenness of the basis weight profile caused by the drying shrinkage by means of crown formation of the slice opening so that the slice opening is thicker in the middle area of the stock jet. This, however, results in cross-direction flows in the slice jet and further in the wire part, which again causes distortion of the fiber orientation. The same phenomenon also affects the cross-direction strength profiles of the web.

In the prior art, a method is known for on-line regulation and measurement of the fiber orientation in a web that is produced by means of a paper machine from the current assignee's Finnish Patent No. 81,848 (corresponding to European Patent No. 408,894). In the method of regulation of a paper machine described in this patent, with the machine configuration and the parameters at each particular time applied in the paper machine to be regulated, data is collected concerning the relationship between the cross-direction distribution of fiber orientation and the basis weight distribution of the web that is being produced so that response runs are carried out with the paper machine in different states of operation of the machine. The data on the relationship that were obtained in the stage defined above is stored in the memory of the computer or equivalent included in the system of regulation of the paper machine. While making use of this data on the relationship, by means of the system of regulation, the distribution of the fiber orientation in the web that is being produced is corrected by regulating the cross-direction profile of the slice opening or equivalent of the headbox. The method of measurement of this patent comprises the two first-mentioned stages and further, a stage in which, while making use of the data on the relationship, the distribution of the fiber orientation in the web is expressed based on the measurement of the cross-direction basis weight profile of the paper web. Response runs are carried out in order to determine the relationship between fiber orientation and basis weight at each particular time, in connection with which response runs, the distribution of the fiber orientation is measured in the laboratory by taking samples out of the web that is being produced. From the samples, the fiber orientations are determined with sufficiently dense spacing in the cross direction of the web by making use of prior art commercial methods and apparatus of laboratory measurement or tests of diagonal tensile strength. Such a high number of response runs and related series of laboratory measurements are carried out that, while average values are computed from the measurement results, a sufficiently good explanatory quality is obtained between the basis weight profile and the fiber orientation profile.

In the manufacture of paper, one of the most important factors that affect the functional properties of paper is the so-called machine-direction/cross-direction ratio of strength. This ratio is controlled by regulating the difference in speed between the jet speed at the headbox and the speed of the forming wire or wires or the ratio of these speeds (hereinafter referred to as the j/w. ratio). Generally, the wire speed is kept invariable, and the regulation takes place by means of regulation of the headbox jet speed.

The ratio of the tensile strengths of paper in the machine direction and in the cross direction is regulated in a way known from the prior art. For example, the tensile strengths are measured in the laboratory at regular intervals, typically from a sample of paper taken from each machine reel. If the tensile strengths are not at the specified level, the j/w ratio at the headbox is usually altered. The tensile strengths can also be affected by means of properties of the stock, but the j/w ratio is the primary parameter of regulation. It is considerably more difficult to act upon the properties of the stock, because such changes, for example grinding and ratios of different stock components, affect almost all quality factors of paper.

As known in the prior art, the headbox jet speed is monitored by measuring the static pressure at the beginning of the slice cone and by converting the pressure value, by means of computations, into the jet speed. In the computations, it is necessary to take into account the geometry of the headbox and the friction and turbulence losses caused by the walls and by possible vanes. In particular, it is very difficult to produce a mathematical model for the losses arising from vanes, which results in problems in the control of the jet speed when changes take place in the running parameters of the headbox, such as-the geometry of the slice part, or when the grade that is produced or the raw-material is changed, in which case a considerable proportion of the paper can be lost in connection with a change of grade before the quality can be regulated and stabilized at an appropriate level. In the prior art, devices for direct measurement of the speed of the discharge jet are also known, but fitting of such devices in the area of the forming gap, in which the space is very limited, is quite difficult and, moreover, the detectors disturb the stability of the jet.

Some of the critical parameters of a paper web are the fiber orientation ratio (hereinafter referred to as the fiber ratio) and the orientation angle, because the fiber ratio affects the properties of strength of paper and board so that the tensile strength of the web in the plane of the paper is substantially higher in the direction of the fibers as compared with the direction perpendicular to the fiber direction. The MD/CD ratio of tensile strength (machine direction/cross direction) of the web is determined by the orientation ratio, i.e., the fiber ratio $O_{max}/-O_{min}$, and the definition of this ratio will be dealt with in more detail in connection with the description related to FIG. 3. The fiber ratio also affects the runnability of a paper machine and a printing and copying machine. For this reason, it is a recognized objective is that the paper should be stronger in the machine direction than in the cross direction, in which case, for example in a printing machine, a paper web that runs in its machine direction endures tension to a greater extent than in the cross direction. Typically, the MD/CD ratio of tensile strength is in a range of from about 0.9 to about 4.5, in the case of printing and writing papers, and more particularly, in a range of from about 1.5 to about 3.5.

In a paper machine, in the web formation, the fiber ratio is affected above all by the j/w ratio. If the wire speed differs from the jet speed, the fibers have a tendency to orient in the machine direction to a greater extent than in the cross direction, in which case, the tensile strength of the web in the machine direction is increased, which is usually desirable. If the slice jet has a cross-direction speed component when it is discharged from the slice opening of the headbox, the principal direction of orientation can differ from the machine direction, in which case, the orientation angle (angle $\alpha$, FIG. 3) becomes larger than zero.

Recently, detectors and systems of measurement of tensile strength/tensile rigidity and of fiber orientation have been introduced in the market. With respect to these, reference is made, by way of example, to the paper in the journal Svensk Papperstidning/Nordisk Cellulosa No. 6:1997, pages 64–66, Gunnar Lindblad: "Infraljudsmätning - ett nytt sätt att styra pappersmaskinen" ('Infrasonic measurement—a new mode of controlling the paper machine').

Further, with respect to the prior art related to the present invention, reference is made to the following published patent applications and patents: International Publication No. WO 97/01088 and U.S. Pat. Nos. 4,133,713, 4,151,415 and 5,145,560.

OBJECTS AND SUMMARY OF THE INVENTION

An object of the present invention is to provide a novel method of regulating a paper machine by means of which it is possible to produce a paper that meets ever stricter requirements of quality, in particular writing and printing paper. The method in accordance with the present invention is suitable both for single layer and for multi-layer web formation.

Another object of the present invention is to utilize advanced detectors in a regulation system for a paper machine, in particular in respect of on-line detectors for fiber orientation and tensile strength of paper web.

In view of achieving the objects stated above and others, the system of regulation in accordance with the invention includes an on-line arrangement of measurement of the dried paper web or the paper web to be dried by means of which, the distribution of its fibers is measured in the plane of the paper web. By means of the measurement signal obtained from this measurement arrangement, the actuators of the headbox are controlled by means of feedback so as to achieve a distribution of fiber orientation and a corresponding MD/CD ratio of strength in accordance with the set value in the paper web to be produced under control of the system of regulation.

In the method of the present invention, the tensile strength, the ratio of tensile strength, the fiber ratio and/or fiber orientation angle is/are measured directly from a dry paper web, i.e., from a finished paper product. This measurement can be carried out by means of a measurement head traversing in the cross direction across the entire width of the web in the paper machine or, as an alternative, by means of one or more stationary measurement heads, each of which is placed in a certain selected location in the cross direction of the paper web. When a traversing measurement head is used, it is possible to compute the average value of the fiber orientation profile or equivalent, or the profile can also be used as a control signal in the regulation of profile, for example in regulation of the profile of the slice opening of the headbox. As an alternative, out of a number of successive scannings of fiber orientation profiles, for example, an average value can be formed, which value is used as a control signal for the system of regulation.

An advantage of the regulation system of the present invention is that the fiber orientation is measured directly on-line from a finished web such that it is not necessary to resort to indirect or slow laboratory measurements and a reliable regulation parameter is obtained quickly to control the regulation system so that a paper with the preset MD/CD ratio of tensile strength can be produced.

It is a further advantage of the present invention that, with the system of regulation of the invention, for example, in connection with change of paper grade, it is possible to make the paper machine to produce a paper that meets the criteria of quality quickly, so that the proportion of paper that becomes broke is reduced substantially from what it was in the prior art paper machines during a paper grade change. This is a considerable advantage in paper machines in which paper grade changes are carried out repeatedly at relatively short intervals. Since the cross-direction shrinkage of paper depends on the orientation profile, a variation in the cross-direction shrinkage has no detrimental effect in the system of regulation, because the measurement of the orientation takes place from a dry paper web after the web has shrunk into its ultimate state in the cross direction.

Thus, a feedback-connected on-line regulation system for a headbox of a paper or board machine includes measurement means for measuring a distribution of fiber orientation in a plane of the web and generating a measurement signal based thereon, a set value unit for providing a desired value for the distribution of fiber orientation in the web, and a regulator unit for receiving the measurement signal from the measurement means and the value from the set value unit and controlling the actuators of the headbox, which affect the profile of a top slice bar defining the slice opening of the headbox, in order to attain a distribution of fiber orientation in accordance with the set values and thus a corresponding machine direction/cross direction ratio of strength. The measurement means may comprise one or more detector arranged to measure the fiber ratio of the web and/or an angle of a main direction of orientation of the fibers in the web in relation to a machine direction. The distribution of fiber orientation is preferably measured while the web is moving at the dry end of the paper machine, before a reel-up if present.

In some embodiments, the measurement means comprise a measurement head which scans in a cross direction of the web perpendicular to a running direction of the web to thereby obtain a cross direction profile of the distribution of fiber orientation. If the measurement head scans in the cross direction at different times, a plurality of measurements of the cross direction profile of the distribution of fiber orientation are obtained and an average value of the cross direction profile of the distribution of fiber orientation being can be computed from the plurality of measurements and the measurement signal being generated based on the average value.

The regulator unit may also be arranged to regulate the static pressure in the slice channel of the headbox based on the measurement signal. The set value unit may include a model of interdependence of tensile strength and/or a ratio of machine direction/cross direction tensile strength of the web and a ratio of the speed of the stock suspension jet to the speed of the wire(s) (j/w ratio). The set value unit determines a set value of the j/w ratio and a set value of static pressure in the headbox in order to attain the set value of the j/w ratio.

The measurement means may also comprise a measurement head including at least one detector for directing a field of oscillation at the web and receiving the same, the measurement signal being obtained from the oscillation. The detector may be a sound oscillation detector, an electromagnetic oscillation detector, a laser detector and a microwave oscillation detector.

The regulation system can be applied to a single-layer headbox or a multi-layer headbox in which the slice channel has an upper duct, a middle duct and a lower duct. A pressure detector is arranged to measure the static pressure in the middle duct which is defined by adjustable vanes.

In a method for controlling a headbox of a paper or board machine, a distribution of fiber orientation in a plane of the web is measured during movement of the web, i.e., on-line, a desired value for the distribution of fiber orientation in the web is determined, and the actuators of the headbox are controlled in order to attain a distribution of fiber orientation in accordance with the set values based on the measured distribution of fiber orientation and the desired value for the distribution of the fiber orientation in the web. The static pressure in the slice channel of the headbox may be regulated based on the measured distribution of fiber orientation in the web. Also, a feed pump which supplies stock to the headbox and/or a dilution profiling system associated with the headbox may be regulated based on the measured distribution of fiber orientation.

In the following, the invention will be described in detail with reference to some exemplifying embodiments of the invention illustrated in the figures in the accompanying drawing. However, the invention is by no means strictly confined to the details of the illustrated embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 4:
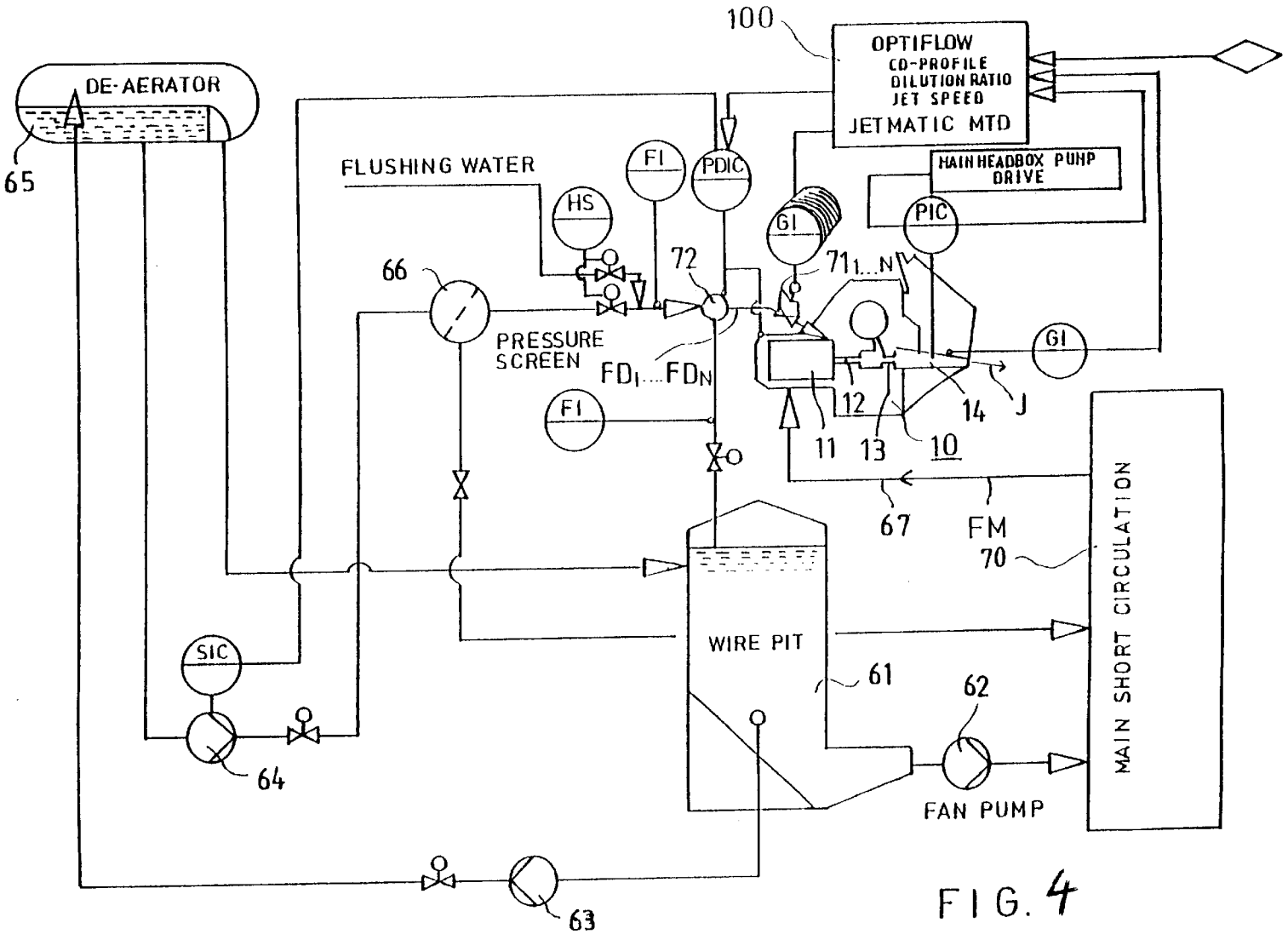
FIG. 4 is a schematic illustration, representing the background and an environment of application of the present invention, of a prior-art stock feed system of a headbox provided with dilution regulation of the CD basis weight profile and of a system of control of the stock feed system.

Referring to the accompanying drawings wherein the same reference numerals refer to the same or similar elements. FIG. 4 shows a system 100 for regulation a headbox 10 of a paper machine by whose means the CD (cross direction) profiles in the paper machine, the dilution ratio, and the speed of a discharge jet J of the headbox 10 are controlled. The discharge jet J of the headbox 10 is discharged into a forming gap defined by the forming wires (not shown). In the manufacture of paper, one important control parameter is the ratio of the speed of the discharge jet J to the speed of the forming wires (not shown) (the j/w ratio). The stock feed system shown in FIG. 4 includes a wire pit 61 which communicates through a pump 62 with the short circulation 70 of the paper machine. From the short circulation 70, a main stock flow FM is obtained and passed through a main stock pipe 67 into an inlet header 11 of the headbox 10. The wire pit 61 communicates with a first feed pump 63 of dilution liquid, which pump passes the dilution liquid into a de-aerator 65. The dilution liquid is fed from the de-aerator 65 by means of a pump 64 through a pressure screen 66 into a dilution header 72, which can be separate from the inlet header 11 of the headbox or integrated with the inlet header, for example, in the way described in the current assignee's Finnish Patent Application No. 970140 which corresponds to U.S. Pat. No. 5,843,281, in which case, it also comprises arrangements for regulation of the edge feed arranged in both of the lateral areas of the headbox in order to control the fiber orientation profile. From the inlet header 72, the dilution flows $FD_1, \ldots, FD_N$ are fed through a series of regulation valves $71_1, \ldots, _N$ into a set of distributor tubes 13 in the turbulence generator 12 of the headbox 10 and further through a slice channel 14 to constitute the stock jet J.

Figure 1A:
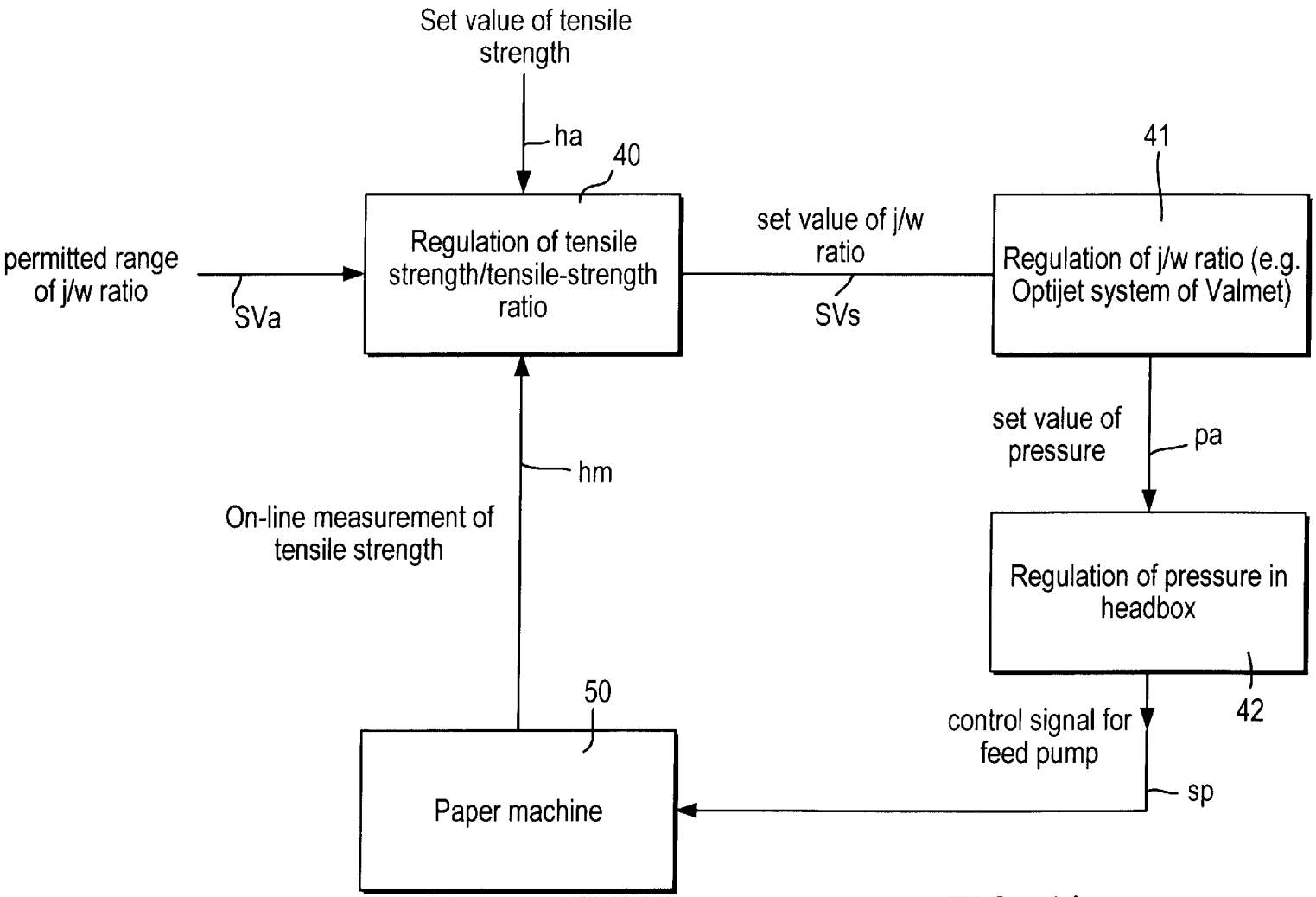
FIG. 1A shows a simplified system diagram of an embodiment of the method of regulation in accordance with the present invention.

The principle of the system of regulation of the invention will be described with reference to the simplified system diagram in FIG. 1A. By means of the system as shown in FIG. 1A, the value of the tensile strength/tensile strength ratio (MD/CD ratio) of the paper web produced by the paper machine is measured and regulated by means of feedback. In FIG. 1A, the paper machine and the papermaking process are represented generally by block 50. In the paper machine, an on-line system of measurement of tensile strength has been arranged in the dry end, which system is, for example, similar to that described in the above paper in the journal Svensk Papperstidning/Nordisk Cellulosa. From the on-line system of measurement of tensile strength, a measurement signal hm is obtained and directed into the system 40 of regulation of tensile strength/tensile-strength ratio. Into this regulation system 40, a set value ha of tensile strength and the permitted range SVa of the j/w ratio are passed. The system 40 includes a model of interdependence of tensile strength and the j/w ratio, on the basis of which model the system 40 determines the set value SVs of the j/w ratio. This set value svs is transferred to the j/w ration regulation system 41 which is, for example, the system of regulation marketed by the current assignee with the trademark Optijet. From the regulation system 41, the set value pa is obtained for the pressure in the slice part of the headbox, the pressure in the headbox being regulated on the basis of the set value pa by means of the system 42. By means of the system 42, the set value of the static pressure of the headbox is measured, on the basis of which value, the control signal sp for the feed pump of the headbox of the paper machine is obtained. By means of the control signal sp, an j/w ratio in compliance with the set value ha of tensile strength is obtained.

Figure 3:
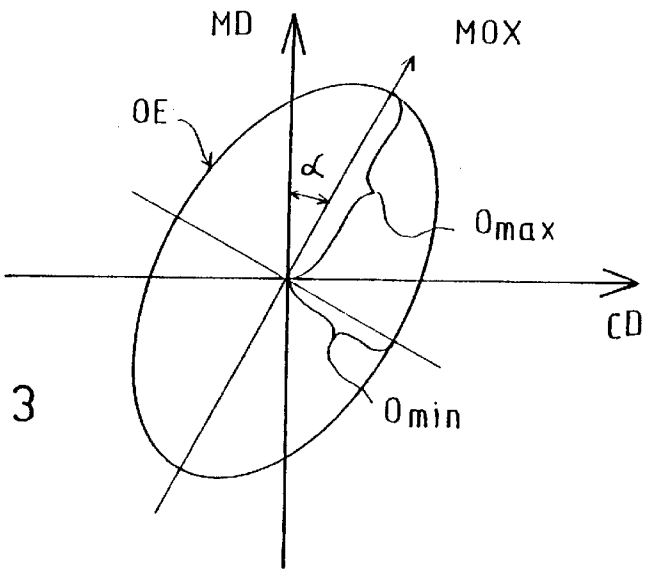
FIG. 3 illustrates a typical distribution of fiber orientation in a machine-direction (MD)/cross-direction (CD) system of coordinates.

FIG. 3 illustrates a typical distribution of fiber orientation OE for paper in a machine-direction (MD)/cross-direction (CD) system of coordinates. The distribution of fiber orientation OE is shaped as an ellipse, and the radius from the origin of the MD-CD system of coordinates to the ellipse of distribution OE represents the relative proportion of the fibers of the paper in the direction of the radius in the plane of the paper. The ellipse of distribution OE has a main axis MOX, in which the distribution $O_{max}$ is at the maximum. The main axis MOX is placed at an angle $\alpha$ in relation to the machine direction MD. The angle $\alpha$ is a so-called orientation angle. In the direction perpendicular to the axis MOX, the distribution of orientation has a minimal value $O_{min}$. The ratio $O_{max}/O_{min}$ is called the fiber ratio. The fiber ratio $O_{max}/O_{min}$ mainly determines the MD/CD tensile-strength ratio of the paper.

Figure 1B:
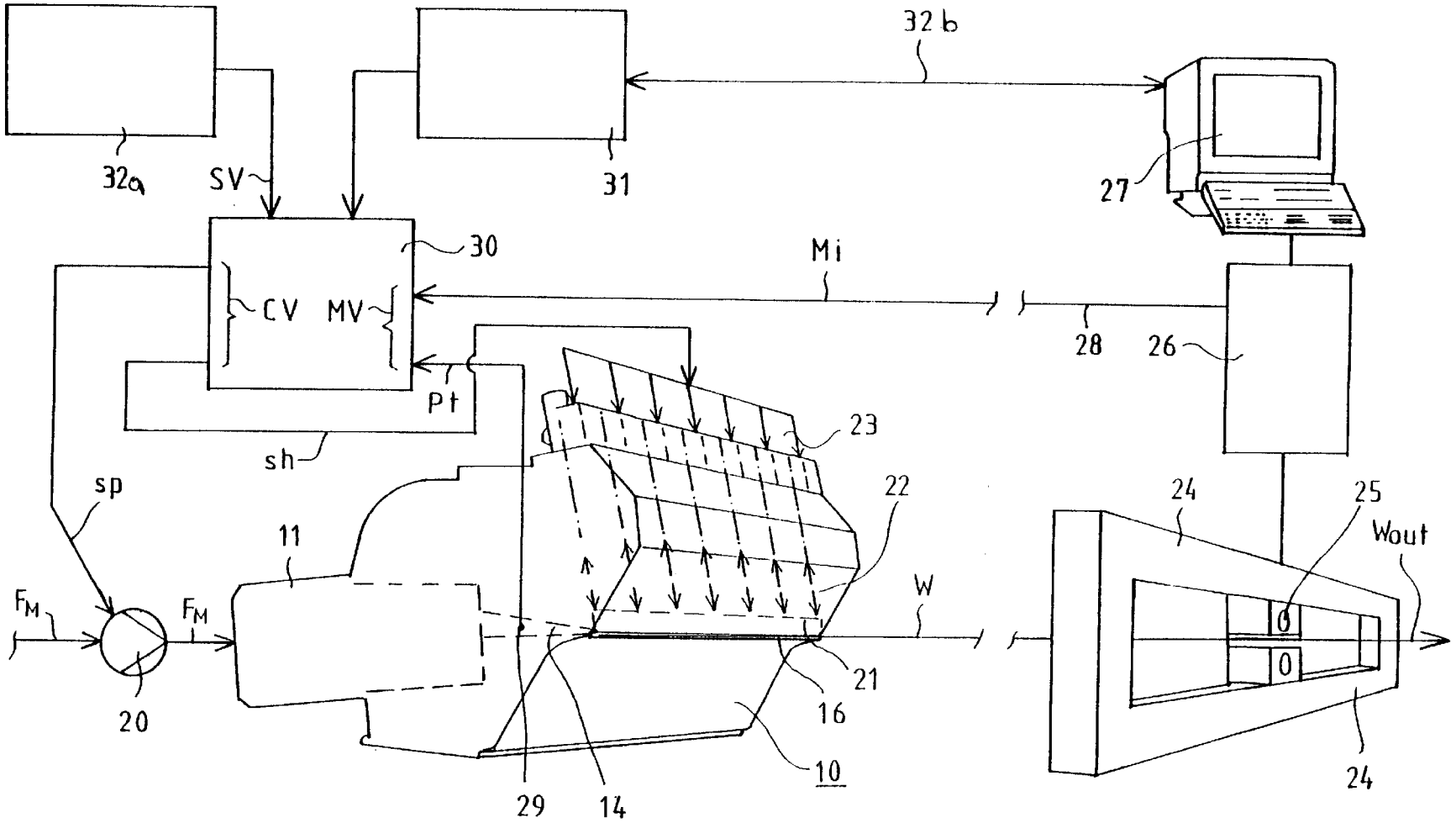
FIG. 1B illustrates a second exemplifying embodiment of the system of regulation in accordance with the present invention more widely than FIG. 1A does.

FIG. 1B is a schematic and simplified illustration of a papermaking process and the on-line system in accordance with the invention for regulation of the ratio of fiber orientation to tensile strength, which system regulates the papermaking process. FIG. 1B shows the headbox of the paper machine having an inlet header 11 into which the feed pump 20 feeds the stock flow FM. The inlet header 11 is followed, for example, by a distributor tube bank, a stilling chamber, a turbulence generator, and the slice channel 14 having a slice opening 16 through which the stock suspension jet is discharged onto the forming wire or into the forming gap formed by the forming wires (not shown). In the paper machine, the paper web W is formed and dried, which web is passed at the dry end of the paper machine through a measurement frame 24 placed before the reel-up. The measurement frame 24 includes one or more measurement heads 25, which preferably traverse in the cross direction of the paper web across its whole width. By means of the measurement frame 24, cross-direction profiles, i.e., CD profiles, of the ready-dried paper web $W_{out}$ are measured on-line, such as basis weight profile, thickness profile, moisture profile, and, in the system of regulation in accordance with the present invention, expressly also the fiber orientation profile or the fiber orientation at a certain specified point or points of the paper web in its cross direction. The measurement detector of fiber orientation or fiber orientation profile can be, for example, a detector based on microwave technology, and the construction and operation of such a detector is described in more detail in International Publication No. WO 97/01088 in the name of Valtion Teknillinen Tutkimuskeskus (Technical Research Center of Finland). This measurement device measures the fiber orientation angle a illustrated in FIG. 3 as well as the so-called fiber ratio $O_{max}/O_{min}$ of the orientation, both of which depend on the j/w ratio, as was described above. The measurement signals of orientation and of the other cross-direction profiles from the measurement head 25 are directed to a processing and transfer unit 26, which is connected to the computer 27 connected with the system of regulation of the paper machine. Computer 27 comprises the necessary display and data transfer devices.

As is shown in FIG. 1B, a series of measurement signals $M_i$ is obtained from the unit 26 through the bus 28, which measurement signals also include a measurement value of the orientation ratio $O_{max}/O_{min}$ and a measurement value of the orientation angle $\alpha$ at a certain point in the cross direction of the paper web W, or the CD profiles of these measurement values. The measurement values $M_i$ are fed to the regulation system 30, to which the measurement signal $p_t$ of static pressure is also fed from a measurement detector 29 associated with the slice channel 14 of the headbox 10. The signals $M_i$ and $p_t$ constitute the measurement values MV of the regulation system 30. Set values SV are fed from the set value unit 32*a* to the regulation system 30. Further, the regulation system 30 is controlled and/or modified by means of the control unit 31, which communicates with the computer 27 through the bus 32*b*. The unit 31 can include, for example, a multi-variable model of the papermaking process, whose construction and application are described in more detail in the current assignee's Finnish Patent Application No. 980319.

As shown in FIG. 1B, the regulation signals CV are obtained from the regulation system 30, which signals include the control signal sp for the feed pump 20 of the headbox and the signal sh, which regulates the CD profile of the slice opening 16 of the headbox 10. By means of the signal sh, the series of actuators 23 of the headbox is regulated which in turn, regulate the spindles 22 which in turn, regulate the top slice bar 21, by whose means the CD profile of the slice opening 16 and, thereby, the basis-weight and fiber-orientation profiles of the paper web W that is being formed are controlled.

The system of regulation as shown in FIG. 1B can operate, for example, so that, by means of fiber orientation profile measured by means of the measurement head 25, expressly fine adjustment of the headbox pressure $p_t$ is carried out so that the orientation ratio $O_{max}/O_{min}$ of the paper $W_{out}$ that is being produced is maintained in compliance with the preset value SV. As stated above, the measurement head 25 can be either traversing and scanning the CD direction and connected with other traversing measurement detectors in the measurement frame 24, such as basis-weight and moisture detectors, or alternatively one or more separate orientation measurement heads 25 can monitor a certain point or points of the web alone with fixed installation.

In accordance with the invention, the feed pump 20 of the headbox 10 is regulated by means of the regulation signal sp obtained from the system 30 so that the fiber ratio $O_{max}/O_{min}$ remains at the set value. In such a case, changes in the mode of running of the paper machine and of the headbox, such as regulation of the width or CD profiling of the slice opening 16, regulation of dilution flow valves or lateral flow valves, and/or changes in the speed of the machine do not have uncontrollable effects on the fiber ratio $O_{max}/O_{min}$ (FIG. 3). If the measurement head 25 measures the cross-direction profile of the fiber orientation ration, in such a case, the fiber ratio can also be used by means of the regulation signal sh for regulation of the slice opening 16 of the headbox 10, beside for regulation of the pressure $p_t$. It is a further advantage of the system in accordance with the invention that the measurement signal is obtained directly from the fiber ratio $O_{max}/O_{min}$, in which case the drying shrinkage profile has no disturbing effect on this measurement signal. A rough value of the j/w ratio can be computed, in a way known from the prior art, from the pressure $p_t$ of the headbox 10, so that the regulation does not become unstable when the speed of the discharge jet J is determined when running with an upper headbox and with a lower headbox.

Figure 2:
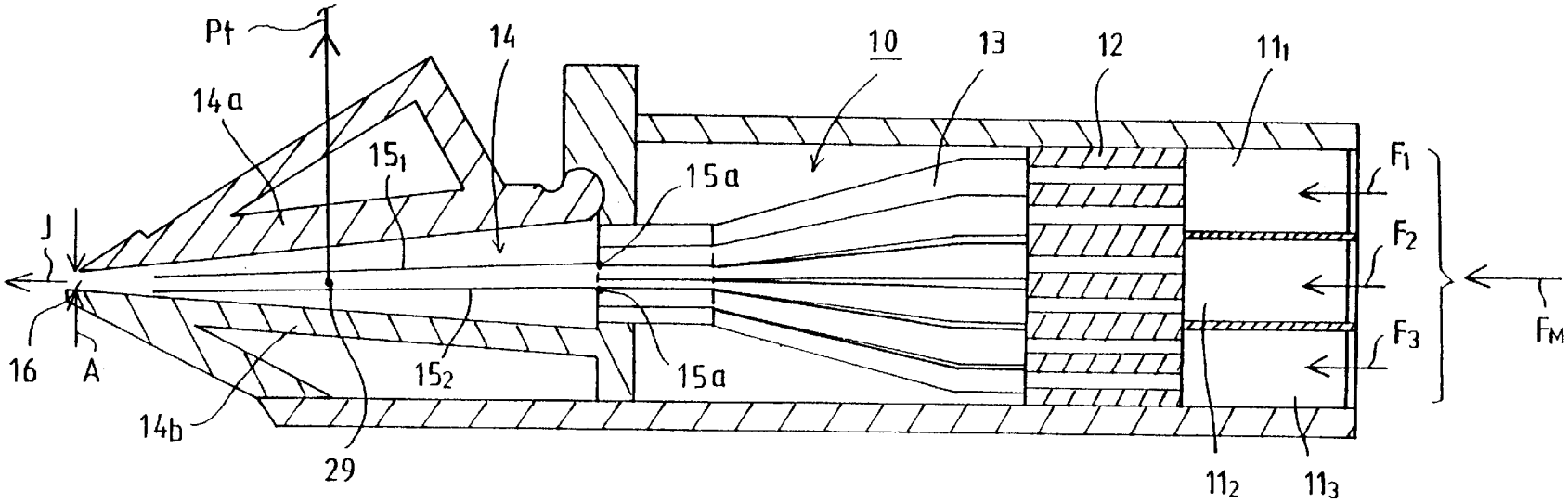
FIG. 2 is a schematic vertical sectional view in the machine direction of a headbox for use in the method in accordance with the present invention.

In the headbox 10 as shown in FIG. 2, the headbox flow FM (corresponds to the flow FM in FIG. 4) has been divided into three separate layers of flows $F_1$, $F_2$, $F_3$, which flows are separate from each other up to the end of the vanes $\mathbf{15}_1$, $\mathbf{15}_2$ in the slice channel 14. In a way similar to the flow FM shown in FIG. 4, in principle, the flow layers $F_1$, $F_2$ and $F_3$ may be comprised of flows consisting of different raw-materials or component flows made of the same basic raw-material with different admixtures and fillers, as is described in more detail, for example, in the current assignee's Finnish Patent No. 92,729. Each of the layers placed one above the other in the headbox 10 has an inlet header $\mathbf{11}_1$, $\mathbf{11}_2$, $\mathbf{11}_3$ of its own, from which the flow is passed into the turbulence generator 12 and further into the distribution tube bank 13. The flows are passed from the distribution tube bank 13 into the slice channel 14.

In the slice channel 14, the flows are separated from each other by means of vanes $\mathbf{15}_5$, $\mathbf{15}_2$, whose initial ends 15*a* are pivotally linked in connection with the final edge of the distribution tube bank 13. The vanes $\mathbf{15}_1$, $\mathbf{15}_2$ can pivot into different positions and be positioned so that they substantially equalize the pressures of the component stock flows. The vanes $\mathbf{15}_1$, $\mathbf{15}_2$ are made of a somewhat elastic material, so that they can also bend.

As shown in FIG. 2, in the middle duct between the vanes $\mathbf{15}_1$ and $\mathbf{15}_2$, a detector 29 for measurement of the static pressure $p_t$ in the slice part 14 of the headbox is arranged. Owing to the free positioning and/or flexibility of the vanes $\mathbf{15}_1$, $\mathbf{15}_2$, the pressure $p_t$ measured by means of the measurement detector 29 adequately illustrates the pressure in the entire slice channel 14. It should be emphasized in this connection that the system of regulation in accordance with the present invention can be applied to head boxes in which there is/are one or several layers placed one above the other, i.e. both to single-layer headboxes and to multi-layer headboxes, the latter sort of headbox being illustrated by FIG. 2 by way of example.

The examples provided above are not meant to be exclusive. Many other variations of the present invention would be obvious to those skilled in the art, and are contemplated to be within the scope of the appended claims.

We claim:

1. A feedback-connected on-line regulation system for a headbox of a paper or board machine, the headbox including an inlet header into which a flow of stock suspension is passed, a slice channel having a slice opening from which a stock suspension jet is discharged, at least one flow duct through which the stock flows between the inlet header and the slice channel and actuators which affect a profile of the stock suspension jet at its discharge from the slice channel, the stock suspension jet being discharged from the slice opening in connection with at least one wire to form a web which is dried, the regulation system comprising measurement means for measuring a distribution of fiber orientation in a plane of the web and generating a measurement signal based on the measured distribution of fiber orientation, a set value unit for providing a desired value for the distribution of fiber orientation in the web, and a regulator unit for receiving the measurement signal from said measurement means and the value from said set value unit and controlling the actuators of the headbox in order to attain a distribution of fiber orientation and a corresponding MD/CD ratio of tensile strength in accordance with the set value, and wherein said regulator unit is arranged to regulate the static pressure of the headbox by controlling a feed pump of said headbox based on the measurement signal.

2. The regulation system of claim 1, wherein said measurement means comprise at least one detector arranged to measure the fiber ratio of the web.

3. The regulation system of claim 1, wherein said measurement means comprise at least one detector arranged to measure an angle of a main direction of orientation of the fibers in the web in relation to a machine direction.

4. The regulation system of claim 1, wherein said measurement means comprise at least one detector arranged to measure the fiber ratio of the web and at least one detector arranged to measure an angle of a main direction of orientation of the fibers in the web in relation to a machine direction.

5. The regulation system of claim 1, wherein said measurement means are arranged to measure the distribution of fiber orientation while the web is moving.

6. The regulation system of claim 1, wherein said measurement means comprise a measurement head scanning in a cross direction of the web perpendicular to a running direction of the web to thereby obtain a cross direction profile of the distribution of fiber orientation.

7. The regulation system of claim 6, wherein said measurement head is arranged to scan in the cross direction at at least two separate times to thereby obtain a plurality of measurements of the cross direction profile of the distribution of fiber orientation, an average value of the cross direction profile of the distribution of fiber orientation being computed from said plurality of measurements and said measurement signal being generated based on said average value.

8. The regulation system of claim 1, wherein said measurement means comprise a single measurement head arranged to measure the distribution of fiber orientation at at least one fixed point.

9. The regulation system of claim 1, wherein said measurement means comprise a plurality of measurement heads, each arranged at a different location in a running direction of the web and to measure the distribution of fiber orientation at at least one fixed point to thereby obtain a plurality of measurements of the distribution of fiber orientation, an average value of the distribution of fiber orientation being computed from said plurality of measurements and said measurement signal being generated based on said average value.

10. The regulation system of claim 1, wherein said set value unit includes a model of interdependence of at least one of tensile strength and a ratio of machine direction/cross direction tensile strength of the web and a ratio of the speed of the stock suspension jet to the speed of the at least one wire (j/w ratio), said set value unit being arranged to determine a set value of the (j/w ratio) and a set value of static pressure in the headbox in order to attain a control signal sp for the feed pump of the headbox.

11. The regulation system of claim 1, wherein said headbox has an associated feed pump and a top slice bar defining the slice opening, the actuators being arranged to profile the top slice bar, said regulator unit being arranged to receive a measured value of the static pressure in the slice channel of the headbox, said measurement means being arranged in a dry end of the paper machine, said regulator unit being further arranged to direct a regulation signal to the feed pump of the headbox and a regulation signal to the actuators which profile the top slice bar.

12. The regulation system of claim 1, wherein said headbox has an associated dilution profiling system, said regulator unit being arranged to receive a measured value of the static pressure in the slice channel of the headbox, said measurement means being arranged in a dry end of the paper machine, said regulator unit being further arranged to direct a regulation signal to the dilution profiling system associated with the headbox.

13. The regulation system of claim 1, wherein said measurement means comprise a measurement head including at least one detector for directing a field of oscillation at the web and receiving the same, said measurement signal being obtained from the oscillation.

14. The regulation system of claim 13, wherein said detector is selected from a group consisting of a sound oscillation detector, an electromagnetic oscillation detector, a laser detector and a microwave oscillation detector.

15. The regulation system of claim 1, wherein the regulation system is applied to a single-layer headbox.

16. The regulation system of claim 1, wherein the regulation system is applied to a multi-layer headbox in which the slice channel has an upper duct, a middle duct and a lower duct, further comprising a pressure detector arranged to measure the static pressure in the middle duct, said middle duct being defined by adjustable vanes.

17. A method for controlling a headbox of a paper or board machine, the headbox including an inlet header into which a flow of stock suspension is passed, a slice channel having a slice opening from which a stock suspension jet is discharged, at least one flow duct through which the stock flows between the inlet header and the slice channel and actuators which affect a profile of the stock suspension jet at its discharge from the slice channel, the stock suspension jet being discharged from the slice opening in connection with at least one forming wire to form a web which is dried, the method comprising the steps of:

measuring a distribution of fiber orientation in a plane of the web during movement of the web, determining a desired distribution of fiber orientation in the web, controlling the actuators of the headbox in order to attain a distribution of fiber orientation and a corresponding MD/CD ratio of tensile strength in accordance with the set values based on the measured distribution of fiber orientation and the the desired distribution of fiber orientation in the web, and regulating the static pressure of the headbox by controlling a feed pump of said headbox based on the measured distribution of fiber orientation in the web.

18. The method of claim 17, wherein the step of measuring the distribution of fiber orientation comprises the step of:

measuring the fiber ratio of the web.

19. The method of claim 17, wherein the step of measuring the distribution of fiber orientation comprises the step of:

measuring an angle of a main direction of orientation of the fibers in the web in relation to a machine direction.

20. The method of claim 17, further comprising the step of:

regulating a dilution profiling system which supplies dilution liquid to the headbox based on the measured distribution of fiber orientation.

* * * * *